United States Patent [19]

Goto

[11] Patent Number: 4,990,483

[45] Date of Patent: Feb. 5, 1991

[54] THERMOSENSITIVE RECORDING MATERIAL

[75] Inventor: Atsuo Goto, Tsukuba, Japan

[73] Assignee: Mitsubishi Paper Mills Limited, Tokyo, Japan

[21] Appl. No.: 419,841

[22] Filed: Oct. 11, 1989

[30] Foreign Application Priority Data

Oct. 13, 1988 [JP] Japan ..... 63-259169

[51] Int. Cl.[5] ..... B41M 5/18

[52] U.S. Cl. ..... 503/226; 427/152; 428/212; 428/913; 503/200

[58] Field of Search ..... 427/152, 150, 151; 503/200, 207, 226; 428/195, 212, 505, 524, 913

[56] References Cited

U.S. PATENT DOCUMENTS 4,686,546 8/1987 Koike et al. ..... 503/200

*Primary Examiner*—Pamela R. Schwartz

*Attorney, Agent, or Firm*—Cushman, Darby & Cushman

[57] ABSTRACT

There is disclosed a thermosensitive recording material comprising a support, an undercoat layer provided thereon and comprising a first layer formed on the support and containing a pigment; a second layer formed on the first layer and containing an ureaformaldehyde resin, and a thermosensitive recording layer provided on the undercoat layer and containing a dye precursor and a developer capable of developing the color of the dye precursor when heated.

7 Claims, No Drawings

THERMOSENSITIVE RECORDING MATERIAL

BACKGROUND OF THE INVENTION

1. Field of the Invention

The present invention relates to a thermosensitive recording material having excellent thermal response and giving a small amount of a deposit on a thermal head.

2. Related Art

Thermosensitive recording materials generally comprise a support and a thermosensitive recording layer provided thereon and containing, as major components, an ordinarily colorless or slightly colored dye precursor and an electron accepting developer. When heated by a thermal head, a thermal pen, a laser beam or the like, the dye precursor instantaneously reacts with the developer to form a recorded image. Thermosensitive recording materials are disclosed in Japanese Patent Examined Publication Nos. 43-4160, 45-14039, etc. Such thermosensitive recording materials have such advantages as recording is made with relatively simple equipment, maintenance is easy and no noise is generated during recording; therefore, said recording materials are in wide use in recorders for measurement, facsimiles, printers, terminal devices for computers, labels, automatic vending machines for railroad tickets, etc. Particularly in the field of facsimiles, demand for facsimiles of thermosensitive mode has greatly increased and, in parallel therewith, it has been pushed forward to develop facsimiles of higher speed in order to reduce the cost for signal transmission and/or facsimiles of lower energy consumption by making them smaller in order to making them less expensive. Correspondently to this trend of facsimiles to higher speed and lower energy consumption, higher sensitivity has been demanded for thermosensitive recording materials. Meanwhile, the dot density of thermal head was generally 8 lines/mm but has recently become higher (e.g. 16 lines/mm) and, in addition, the area of each dot has become smaller. Hence, it has been required to print small-sized characters in higher image quality or to print characters with density gradation by Dither method. Thus, better printability, namely, to form images having faithfully reproduced head dots has been required more than before.

When, in order to satisfy the above requirements, adhesion between a recording sheet and a thermal head is improved by subjecting the recording sheet to supercalendering of stronger degree, there appear defects such as decreased whiteness (so-called, background stain) and the like.

It is proposed in Japanese Patent Application KOKAI (Laid-Open) No. 56-27394 to provide an undercoat layer between a thermosensitive recording layer and a base paper. By the provision of such an undercoat layer, it has become possible to obtain an image of higher density with a small energy without applying strong supercalendering and thereby to achieve higher sensitivity. It is believed that the provision of this undercoat layer would be effective to smoothen the unevenness of the surface of a support and thereby to making smooth the surface of a thermosensitive recording layer.

As described above, by the provision of an undercoat layer, recording of higher sensitivity became possible. However, requirements in recent years for recording of still higher sensitivity and more improvement in dot reproducibility cannot be satified only by the provision of an undercoat layer which simply aims at smoothening the surface of thermosensitive recording material.

SUMMARY OF THE INVENTION

The object of the present invention is to respond to the requirement for higher sensitivity which could not be solved by the above mentioned conventional techniques and to provide a thermosensitive recording paper having improved thermal response and improved dot reproducibility and giving a smaller amount of a deposit on a thermal head.

According to the present invention, there is provided a thermosensitive recording material comprising a support, an undercoat layer provided thereon and comprising a first layer formed on the support and containing a pigment, a second layer formed on the first layer and containing an urea-formaldehyde resin and, optionally, a third layer formed on the second layer and containing a pigment, and a thermosensitive recording layer provided on the undercoat layer and containing a dye precursor and a developer capable of developing the color of the dye precursor when heated.

DETAILED DESCRIPTION OF PREFERRED EMBODIMENTS

That the first layer of the undercoat layer contains a pigment is effective to improve the surface unevenness of the support and thereby to obtain a smooth surface. That the second layer contains an urea-formaldehyde resin is effective to prevent the thermal energy supplied from a thermal head from irradiating out of the thermosensitive recording material and thereby to allow the thermal energy to act on the thermosensitive recording layer more effectively, because the urea-formaldehyde resin has a heat-insulating property due to (a) its low heat conductivity and (b) the air-holding property possessed by the porosity of the urea-formaldehyde resin powder and further has pressure deformability. It is believed that the urea-formaldehyde resin further has an action of making the smooth surface obtained by the formation of the first layer, more smooth.

The thus prepared thermosensitive recording paper can make the best use of the effects of the urea formaldehyde resin contained in the second layer, i.e. the heat-insulating property due to (a) its low heat conductivity and (b) the air-holding property possessed by the porosity of the urea-formaldehyde resin powder and the pressure deformability, whereby improved thermal response and improved dot reproducibility can be obtained. When a thermosensitive recording layer is formed directly on the urea-formaldehyde resin layer, however, it occurs in some cases that the dye precursor and the developer are melted by the thermal energy suplied from a thermal head and absorbed by the porous urea-formaldehyde resin layer and resultantly the colored image is shielded thereby reducing the image density; there also occur in some cases the formation of a deposit on a thermal head, or sticking during printing. Hence, it is thought that formation of a third undercoat layer containing an oil-absorbing inorganic pigment, on the urea-formaldehyde resin layer serves to prevent or reduce the above mentioned problems and to further improve the surface smoothness which has been made better by the formation of the second layer.

The second layer, when consisting of an urea-formaldehyde resin alone, can make the best use of its heat-insulating property and pressure deformability and thereby can provide improved thermal response and improved dot reproducibility as desired. However, such a second layer has low adhesion and, when writing is made on the resulting thermosensitive recording paper with a pencil, etc., may cause delamination. The adhesion can be improved by increasing the amount of an adhesive used, but the use of the adhesion in too large an amount reduces the heat-insulating property of the urea-formaldehyde resin. Our study indicated that this problem can be solved by adding 10% by weight or more of a pigment (different from the one used in the first layer) to an urea-formaldehyde resin to form a second layer. Use of said pigment in too large an amount reduces the heat-insulating property of the urea-formaldehyde resin as well; therefore, the amount of said pigment used is preferably 10 - 50% by weight although the amount differs by the extent of the effect expected for the pigment.

As the pigment used in the first layer of the present invention, there can be used, for example, inorganic pigments such as calcium carbonate, kaolin, calcined kaolin, zinc oxide, titanium oxide, aluminum hydroxide, zinc hydroxide, barium sulfate, silicon oxide, etc., as well as organic pigments, for example, fine particles of polyethylene, polystyrene, ethylenevinyl acetate copolymer, urea-formaldehyde resin, etc.

These pigments can be used alone or in combination of two or more.

As the pigment used in the second layer of the present invention in combination with an urea-formaldehyde, there can be used organic pigments other than urea formaldehyde resins, for example, fine particles of polystyrene, ethylene-vinyl acetate copolymer, etc., as well as pigments ordinarily used in coated paper, etc., such as calcium carbonate, kaolin, calcined kaolin, zinc oxide, titanium oxide, aluminum hydroxide, zinc hydroxide, barium sulfate, silicon oxide and the like. These pigments can be used alone or in combination of two or more, in combination with an urea-formaldehyde resin.

As the pigment used in the third layer of the present invention, there can be used inorganic pigments such as calcium carbonate, kaolin, calcined kaolin, zinc oxide, titanium oxide, aluminum hydroxide, zinc hydroxide, barium sulfate, silicon oxide and the like. These inorganic pigments can be used alone or in combination of two or more. Optionally, there can be used organic pigments, for example, fine particles of urea-formaldehyde resin, polyethylene, polystyrene, ethylene-vinyl acetate copolymer, etc. These organic pigments can be used alone or in combination of two or more. It is possible to use the above inorganic pigments and organic pigments in combination. Of these, preferable are pigments having an oil-absorbability of 70 ml/100 g or more, particularly kaolin and silicon oxide, because they not only have the previously mentioned effects but also can absorb the heat-melted dye precursor and developer without shielding the color formed by them unlike the urea-formaldehyde resin powder and reduces the amount of the deposit formed on a thermal head.

The first layer exhibits its required effect when formed in an amount of 1 g/m$^2$ or more. When the amount is too large, the thickness of the coated paper becomes large, which impairs the properties of the base paper used. When the thickness of the base paper is made smaller to allow the resulting paper to have a given thickness, the coated paper has a problem in flexural rigidity Accordingly, 3–10 g/m$^2$ is preferred as the amount of the first layer. The second layer exhibits its required effect when formed in an amount of 1 g/m$^2$ or more. When the amount is too large, there arises the same problem as in the case of the first layer. Therefore, 3–15 g/m$^2$ is preferred. The amount of the third layer is most preferably 1–10 g/m$^2$ in order for the third layer to exhibit its required effect without impairing the effect of the second layer. When the amount of the third layer is too large, the heat conduction within the thermosensitive recording paper is reduced, making it impossible in some cases to fully utilize the heat-insulating property and elasticity of the second layer By providing a thermosensitive recording layer on the thus formed undercoat layer, there can be obtained a thermosensitive recording paper having desired properties.

The dye precursor used in the present invention is not particularly limited so long as it is generally used in pressure-sensitive recording papers or thermosensitive recording papers. Specific examples include the following dye precursors.

(1) Triarylmethane compounds:

3,3-bis(p-dimethylaminophenyl)-6-dimethylaminophthalide (Crystal Violet lactone), 3,3-bis(pdimethylaminophenyl)phthalide, 3-(p-dimethylaminophenyl)-3-(1,2-dimethylindol-3-yl)phthalide, 3-(p-dimethylaminophenyl)-3-(2-phenylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds:

4,4'-bis-dimethylaminophenyl benzhydryl benzyl ether, N-halophenyl leuco Auramine, N-2,4,5-trichlorophenyl leuco Auramine, etc.

(3) Xanthene compounds:

Rhodamine B anilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7chlorofluorane, 3-diethylamino-6-chloro-7-methylfluorane, 3-diethylamino-7-(3,4-dichloroanilino)fluorane, 3-diethylamino-7-(2-chloroanilino)fluorane, 3-diethylamino-6-methyl-7-anilinofluorane, 3-(N-ethyl-N-tolyl)amino-6-methyl-7-anilinofluorane, 3-piperidino-6-methyl-7-anilinofluorane, 3-(N-ethyl-N-tolyl)amino-6-methyl-7phenethylfluorane, 3-diethylamino-7-(4-nitro-anilino)-fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-(N-ethyl-N-tetrahydrofuryl)amino-6-methyl-7-anilinofluorane, etc.

(4) Thiazine compounds:

benzoyl leuco methylene blue, p-nitrobenzoyl leuco methylene blue, etc.

(5) Spiro compounds:

3-methyl-spiro-dinaphthopyran, 3-ethyl-spirodinaphthopyran, 3,3'-dichloro-spiro-dinaphthopyran 3-benzyl-spiro-dinaphthopyran, 3-methylnaphtho-(3-methoxybenzo)spiro-pyran, 3-propyl-spiro-benzopyran, etc.

These dye precursors can be used singly or as admixtures of two ore more.

As the color developer used in the present invention, electron accepting compounds generally employed for thermosensitive papers are used; in particular, phenol derivatives, aromatic carboxylic acid derivatives or metal compounds thereof, N,N'-diarylthiourea derivatives, etc. are used. Among them, particularly preferred are phenol derivatives. Specific examples are p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)-propane, 1,1-bis(p-hydroxyphenyl)pentane, 1,1-bis(p-hydroxyphenyl)hexane, 1,1-bis(p-hydroxyphenyl)-cyclohexane, 2,2-bis(p-hydroxyphenyl)propane, 2,2-bis(p-hydroxyphenyl)butane, 2,2-bis(p-hydroxyphenyl)-hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di[2-(p-hydroxyphenyl)-2-propyl]benzene, 1,3-di[2-(3,4-dihydroxyphenyl)-2-propyl]benzene, 1,4-bis[2-(p-hydroxyphenyl)-2-propyl]benzene, 4,4'-dihydroxydiphenyl ether, 4,4'-dihydroxydiphenylsulfone, 3,3'-diallyl-4,4'-dihydroxydiphenylsulfone, 3,3'-dichloro-4,4'-dihydroxydiphenyl sulfide, methyl 2,2-bis(4-hydroxyphenyl)acetate, butyl 2,2-bis(4-hydroxyphenyl)acetate, 4,4'-thiobis(2-t-butyl-5-methylphenol), bis(3-allyl-4-hydroxyphenyl)sulfone, 4-hydroxy4'-isopropyloxydiphenylsulfone, 3,4-dihydroxy-4'-methyldiphenylsulfone, benzyl p-hydroxybenzoate, chlorobenzyl p-hydroxybenzoate, propyl p-hydroxybenzoate, butyl p-hydroxybenzoate, dimethyl 4-hydroxyphthalate, benzyl gallate, stearyl gallate, salicylanilide, 5-chlorosalicylanilide, etc.

In addition, the thermosensitive layer may also contain, as pigments, diatomaceous earth, talc, kaolin, calcined kaolin, calcium carbonate, magnesium carbonate, titanium oxide, zinc oxide, silicon oxide, aluminum hydroxide, urea-formalin resin, etc. The layer may further contain, as additives for further improvement of the sensitivity, waxes such as N-hydroxymethylstearic amide, stearic amide, palmitic amide, etc.; naphthol derivatives such as 2-benzyloxynaphthalene, 1-hydroxy2-phenoxynaphthalene, 1-hydroxy-2-phenoxynaphthalene, etc.; biphenyl derivatives such as p-benzylbiphenyl, 4-allyloxybiphenyl, etc.; polyether compounds such as 1,2-bis(3-methylphenoxy)ethane, 2,2'-bis(4-methoxyphenoxy)diethyl ether, bis(4-methoxyphenyl) ether, etc.; carbonate or oxalate diester derivatives such as diphenyl carbonate, dibenzyl oxalate, di(p-fluorobenzyl) oxalate, etc.

In addition, there may be incorporated, for purposes of preventing head abrasion, sticking, etc., higher fatty acid metal salts such as zinc stearate, calcium stearate, etc.; waxes such as paraffin, oxidized paraffin, polyethylene, oxidized polyethylene, stearic amide, castor wax, etc.; dispersing agents such as sodium dioctylsulfosuccinate, etc.; UV absorbing agents of benzophenone type, benzotriazole type, etc. and further surface active agents, fluorescent dyes, etc., if necessary.

In the present invention, as the adhesives used in the first, second and third undercoat layers and the thermosensitive recording layer, various adhesives generally used are usable. Examples of the adhesives include water soluble adhesives such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylate copolymer, acrylamide/acrylate/ methacrylic acid ternary copolymer, alkali salts of styrene/maleic anhydride copolymer, alkali salts of ethylene/maleic anhydride copolymer, etc., as well as latexes of polyvinyl acetate, polyurethane, polyacrylates, styrene/butadiene copolymer, acrylonitrile/ butadiene copolymer, methyl acrylate/butadiene copolymer, ethylene/vinyl acetate copolymer, etc.

As the support used in the present invention, paper is mainly used. Non-woven cloth, a plastic film, synthetic paper, metal foil or the like, or a composite sheet obtained by combining them may optionally be employed.

Next, the present invention is described in more detail by referring to Examples.

Parts and % shown below are all by weight. Numeral values representing each coated amount are a dry weight, unless otherwise specified.

EXAMPLE 1

(1) Preparation of solution A (coating solution for first and third layers)

A mixture having the following composition was stirred to prepare a coating solution for first and third layers.

| | |
|---|---|
| ANSILEX (calcined kaolin, manufactured by Engelhardt Co., Ltd.) | 100 parts |
| Styrene-butadiene copolymer latex (50% aqueous dispersion) | 24 parts |
| MS 4600 (phosphated starch, 10% aqueous dispersion, manufactured by Nippon Shokuhin K.K.) | 60 parts |
| Water | 52 parts |

(2) Preparation of solution B (coating solution for second layer)

A mixture having the following composition was stirred to prepare a coating solution for second layer.

| | |
|---|---|
| UNISEAL (urea-formaldehyde resin, manufactured by Ciba-Geigy Corporation) | 15 parts |
| ANSILEX (calcined kaolin, manufactured by Engelhardt Co., Ltd.) | 5 parts |
| Styrene-butadiene copolymer latex (50% aqueous dispersion) | 6 parts |
| Water | 80 parts |

(3) Preparation of thermosensitive coating solution.

A mixture having the following composition was ground into an average particle diameter of about 1 μm by a sand grinder to prepare [solution c] and

| | |
|---|---|
| [Solution C] | |
| 3-Dibutylamino-6-methyl-7-anilinofluorane | 40 parts |
| 10% Polyvinyl alcohol aqueous solution | 20 parts |
| Water | 40 parts |
| [Solution D] | |
| Bispenol A | 50 parts |
| Benzyloxynaphthalene | 50 parts |
| 10% Polyvinyl alcohol aqueous solution | 50 parts |
| Water | 100 parts |

Then, a thermosensitive coating solution was prepared in the following composition, using the thus prepared [solution C] and [solution D].

| | |
|---|---|
| [Solution C] | 50 parts |
| [Solution D] | 250 parts |
| Zinc stearate (40% aqueous dispersion) | 25 parts |
| 10% polyvinyl alcohol aqueous solution | 216 parts |
| Calcium carbonate | 50 parts |
| Water | 417 parts |

Each of the thus prepared coating solutions was coated on a base paper weighing 40 g/m$^2$ in the following amount with a Mayor bar to prepare a thermosensitive recording material.

| | |
|---|---|
| First layer | 8 g/m$^2$ |
| Second layer | 8 g/m$^2$ |
| Third layer | 4 g/m$^2$ |
| Thermosensitive layer | 5.5 g/m$^2$ |

EXAMPLE 2

A thermosensitive recording material was prepared in the same manner as in Example 1 except that no third layer was formed.

EXAMPLE 3

A thermosensitive recording material was prepared in the same manner as in Example 1 except that the amount of the second layer was changed from 8 g/m$^2$ to 4 g/m$^2$.

EXAMPLE 4

A thermosensitive recording material was prepared in the same manner as in Example 1 except that the amount of the first layer was changed from 8 g/m$^2$ to 4 g/m$^2$.

EXAMPLE 5

A thermosensitive recording material was prepared in the same manner as in Example 1 except that in the preparation of solution A, 100 parts of ANSILEX was replaced by 100 parts of Ultra White 90 (kaolin for coating purpose, manufactured by Engelhardt Co., Ltd.) and the thus prepared solution was coated for formation of a first layer.

EXAMPLE 6

A thermosensitive recording material was prepared in the same manner as in Example 1 except that in the preparation of solution A, 100 parts of ANSILEX was replaced by 100 parts of Ultra White 90 (kaolin for coating purpose, manufactured by Engelhardt Co., Ltd.) and the thus prepared solution was coated for formation of a first layer.

EXAMPLE 6

A thermosensitive recording material was prepared in the same manner as in Example 1 except that in the preparation of solution A, 100 parts of ANSILEX was replaced by 100 parts of Ultra White 90 (kaolin for coating purpose, manufactured by Engelhardt Co., Ltd.) and the thus prepared solution was coated for formation of a third layer.

EXAMPLE 7

A thermosensitive recording material was prepared in the same manner as in Example 1 except that in the formation of solution B, 5 parts of ANSILEX was replaced by 5 parts of Ultra White 90 (kaolin for coating purpose, manufactured by Engelhardt Co., Ltd.) and the thus prepared solution was used as a coating solution for second layer.

EXAMPLE 8

A thermosensitive recording material was prepared in the same manner as in Example 1 except that in the preparation of solution B, 15 parts of UNISEAL and 5 parts of ANSILEX were replaced by 20 parts of ANSILEX alone and the resulting solution was used as a coating solution for second layer.

COMPARATIVE EXAMPLE 1

A thermosensitive recording material for comparative purpose was prepared in the same manner as in Example 1 except that no first layer was formed.

COMPARATIVE EXAMPLE 2

A thermosensitive recording material for comparative purpose was prepared in the same manner as in Example 1 except that no third layer was formed.

COMPARATIVE EXAMPLE 3

A thermosensitive recording material for comparative purpose was prepared in the same manner as in Example 1 except that the solution A was used in place of the solution B, for formation of a second layer.

The thus prepared thermosensitive recording materials were treated by supercalendering so as to have a Beck's smoothness of 400 to 500 seconds, and then were examined for recording density, printability and degree of deposit formation, using a G III facsimile test machine. The test machine was TH-PMD manufactured by Okura Electric Co., Ltd. having a thermal head showing its dot density of 8 dots/mm and its head resistance of 185 ohm. Printing was effected at a head voltage of 15 V for each time span of 0.10 ms or 0.12 ms. Recording density was measured with a Macbeth RD-918 reflection densitometer. The results are shown in Table 1.

TABLE 1

| | Sensitivity | | Print- | Deposit | |
|---|---|---|---|---|---|
| | 0.10 ms | 0.12 ms | ability | formation | Adhesion |
| Example | | | | | |
| 1 | 0.85 | 1.27 | ○ | ○ | ○ |
| 2 | 0.75 | 1.18 | ○~Δ | ○~Δ | ○ |
| 3 | 0.82 | 1.24 | ○ | ○ | ○ |
| 4 | 0.83 | 1.26 | ○ | ○ | ○ |
| 5 | 0.80 | 1.21 | ○ | ○ | ○ |
| 6 | 0.77 | 1.17 | ○ | ~Δ | ○ |
| 7 | 0.81 | 1.23 | ○ | ○ | ○ |
| 8 | 0.86 | 1.27 | ○ | ○ | ~Δ |
| Comparative Example | | | | | |
| 1 | 0.60 | 0.93 | X~Δ | ○~Δ | ○ |
| 2 | 0.70 | 1.14 | Δ | ○ | ○ |
| 3 | 0.55 | 0.92 | X~Δ | ○ | ○ |
| 4 | 0.64 | 1.05 | Δ | ○ | ○ |

○: : Good
Δ: Not good
○~Δ: Relatively good
X: Bad

As is clear from Table 1, the thermosensitive recording materials of the present invention comprise a support, an undercoat layer provided thereon and comprising a first layer formed on the support and containing a pigment, a second layer formed on the first layer and containing an urea-formaldehyde resin and a third layer formed on the second layer and containing an oil-absorbing pigment, especially inorganic one, and a thermosensitive recording layer provided on the undercoat layer, and are superior to conventional thermosensitive recording materials in thermal response, and could achieve improvements in sensitivity and dot reproducibility without increasing the degree of deposit formation on thermal head.

What is claimed is:

1. A thermosensitive recording material comprising a support; an undercoat layer comprising a first layer in an amount of 1 $g/m^2$ or more formed on the support containing a pigment and an adhesive and a second layer in an amount of 1 $g/m^2$ or more formed on the first layer, comprising an urea-formaldehyde resin and an adhesive; and a thermosensitive recording layer, provided on the undercoat layer, containing an adhesive, a dye precursor and a developer capable of developing the color of the dye precursor when heated.

2. A thermosensitive recording material according to claim 1, wherein the undercoat layer further comprises a third layer formed on the second layer in the amount of 1 $g/m^2$ or more and containing a pigment.

3. A thermosensitive recording material according to claim 2, wherein the pigment used in the third layer of the undercoat layer has an oil-absorbability of 70 ml/100 g or more.

4. A thermosensitive recording material according to claim 4, wherein the pigment having an oil-absorbability of 70 ml/100 g or more is calcined kaolin or silicon oxide

5. A thermosensitive recording material according to claim 2 wherein the third layer is formed in an amount of 3–10 $g/m^2$.

6. A thermosensitive recording material according to claim 1, wherein the second layer of the undercoat layer is a mixture of an urea formaldehyde resin and a pigment, other than that in the first layer.

7. A thermosensitive recording material according to claim 1, wherein the first layer is formed in an amount of 3–10 $g/m^2$ and the second layer is formed in an amount of 3–10 $g/m^2$.

* * * * *